US007779517B1

(12) United States Patent
Stewart

(10) Patent No.: US 7,779,517 B1
(45) Date of Patent: Aug. 24, 2010

(54) MAGNETIC CLASP FOR JEWELRY ARTICLE

(76) Inventor: Harry G. Stewart, 4461 E. Genesee St., Syracuse, NY (US) 13214

( * ) Notice: Subject to any disclaimer, the term of this patent is extended or adjusted under 35 U.S.C. 154(b) by 0 days.

(21) Appl. No.: 12/432,131

(22) Filed: Apr. 29, 2009

(51) Int. Cl.
*A44B 18/00* (2006.01)
*A44C 11/02* (2006.01)

(52) U.S. Cl. ..... 24/303; 63/3.1; 63/900; 24/633; 24/326

(58) Field of Classification Search ..... None
See application file for complete search history.

(56) References Cited

U.S. PATENT DOCUMENTS 3,168,768 A 2/1965 Bohlinger et al.
3,181,217 A 5/1965 Bohlinger et al.
3,225,565 A 12/1965 Bohlinger et al.
4,573,243 A * 3/1986 Plaza ..... 24/116 A
5,007,252 A 4/1991 Mochizuki
5,195,335 A 3/1993 Hart
5,349,725 A * 9/1994 Levy ..... 24/303
5,722,260 A * 3/1998 Mangano ..... 63/3.1
6,349,568 B1 2/2002 Ito
7,024,886 B1 4/2006 Ito
7,334,433 B1 2/2008 Fuhrman et al.
7,536,759 B2 * 5/2009 Hoshino ..... 24/633

* cited by examiner

*Primary Examiner*—Jack W. Lavinder
(74) *Attorney, Agent, or Firm*—Bernhard P. Molldrem, Jr.

(57) ABSTRACT

A decorative clasp closes by magnetic action, and can be worn on the front, i.e. at the throat or beneath the throat. The clasp allows the loop size of the jewelry article to be adjusted to suit the wearer's preferences. A pair of arcuate arms are joined at a pivot member, and close magnetically to form a generally oval shape.

9 Claims, 2 Drawing Sheets

MAGNETIC CLASP FOR JEWELRY ARTICLE

BACKGROUND OF THE INVENTION

This invention relates to jewelry clasp in which one end of a string or strand of beads, i.e., a necklace or bracelet, is attached to the clasp, and a hinged oval loop or bight closes over the string or strand near the other end, i.e., between two beads on the jewelry article. The invention is more specifically directed to a decorative clasp which closes by magnetic action, and which can be worn on the front, i.e. at the throat or beneath the throat, and which allows the loop size of the jewelry article to be adjusted to suit the wearer's preferences.

Typically, clasps for closing a necklace or similar string of beads, pearls, or gemstones employs a two-part mechanical clasp of which one part is attached to one end of the string or strand, and the other mating part is attached to the other end. These are usually mechanical closures, although in some cases magnetic action has been employed. One example of a magnetic clasp for a necklace is discussed in Fuhrman et al. U.S. Pat. No. 7,334,433. A magnetic clasp is also discussed in Ito U.S. Pat. No. 6,349,568, in which the clasp is of the center-bend type, formed of a pair of arcuate members that pivot from one end attached to the end of the necklace, with the mouth of the clasp being closed by magnets at the free ends of these members. Alternatively, the clasp may be formed of a soft resin such as polyethylene folding in half and closed magnetically.

An ornamental closure or hook for latching one end of a strand of pearls at a place between two pearls near the other end is discussed in Ito U.S. Pat. No. 7,024,886. This may be worn in front. However, the device requires mechanically placing a hook in the space between two pearls. Other decorative front-mounted pearl necklace shorteners have appeared as well, e.g., in Bohlinger et al. U.S. Pat. No. 3,225,565. These typically require a great deal of finger dexterity to attach and release, and often cannot provide the desired appearance to match the look of the string of beads or pearls.

OBJECTS AND SUMMARY OF THE INVENTION

Accordingly, it is an object of the present invention to provide a jewelry article, and a magnetic action jewelry clasp arrangement that avoid the drawbacks of the prior art.

It is another object to provide a jewelry clasp arrangement that opens and closes easily, using magnetic action, which does not require a high level of dexterity to open and close, and which has an attractive look that enhances the appearance of the jewelry article.

It is a more specific object to provide a pair of simple and straightforward clasp that permits shortening of a strand of beads, i.e., pearls, gemstones, or artificial spheres or other shapes, so that the same string or strand can be worn at different lengths to suit the occasion and the desires of the wearer.

In accordance with one aspect of the present invention, a jewelry item is formed as a plurality of bead members strung in line upon a flexible cord, and a jewelry clasp is attached onto one end of the flexible cord. The clasp closes over a narrow space or valley defined between successive ones of said bead members. In embodiments of this invention the clasp is formed of a first arm member that has an eyelet that is adapted to receive said one end of the cord, so it can be attached, i.e., tied, to the one end of the string or strand. A first magnet is disposed at a distal end portion of this first arm member. A second, arcuate arm member extends distally from the first magnet, and a pivot member is situated at the far or distal end of this second, arcuate arm member. A third, arcuate arm member has a pivot end joined to this pivot member, and the third arm member extends proximally therefrom, i.e., back towards the first magnet and the first arm. In this construction, the third arcuate arm member is adapted to open out from said second arm member and close towards said second arm member. A second magnet is affixed at a proximal end of the third arcuate arm member and is positioned to mate magnetically against the first magnet. Favorably, the second and third arcuate arm members bow out in respect to one another to define an oval-shaped loop that engages the strand of pearls or beads when said second magnet engages and closes against the first magnet.

In some embodiments, the third arcuate arm member, i.e., the movable arm can be disposed behind the second or fixed arcuate arm member, so that the clasp opens and closes at the rear, i.e., towards the wearer's neck. In other preferred embodiments, the third or movable arcuate arm member is disposed in front of the second arcuate arm member, so that the clasp opens and closes at the front, i.e., the side away from the wearer's neck. The clasp can be adorned with a first decorative leaf member disposed upon the first arm member and/or may also have a second decorative leaf member disposed upon the movable or third arm member. The leaf member may be designed to represent foliage, or a blossom, or any other shape, or may be a non-representational abstract design, depending on the tastes of the jeweler and/or the wearer. The second decorative leaf member can extend proximally over the second magnet, and thus may conceal much of the closure parts of the clasp.

Favorably, the first and second magnets may each include a generally cylindrical socket in which a permanent magnet member is fitted.

Terms such as bead, string, leaf, and oval, as used in the description and in the claims, should be interpreted broadly, and not limited to the illustrated embodiment.

The above and many other objects, features, and advantages of this invention will be more fully appreciated from the ensuing description of a preferred embodiment, which is to be read in conjunction with the accompanying Drawing.

DETAILED DESCRIPTION OF THE PREFERRED EMBODIMENT

Figure 1:
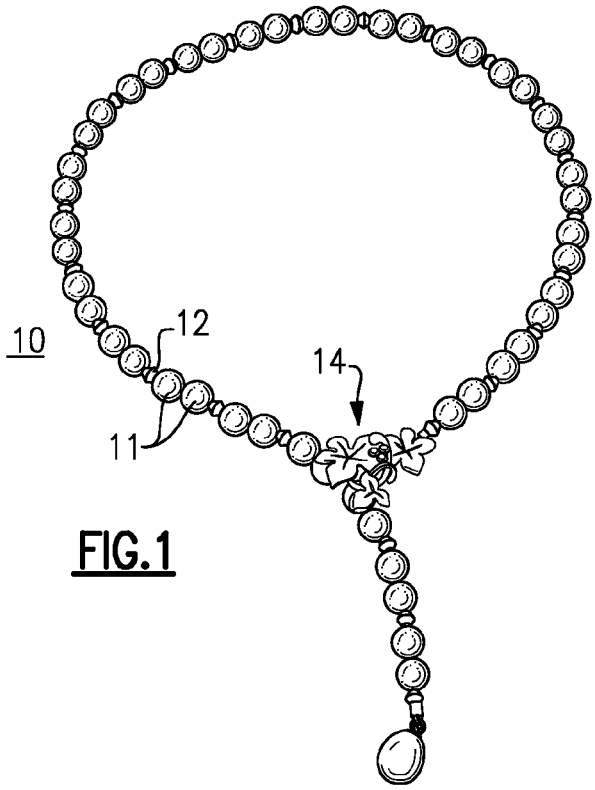
FIG. 1 is a perspective view of a jewelry item, in the form of a strand of round beads, which may be pearls, or may be gemstones, ceramic beads or other items strung on a flexible string, wire or cord, and featuring a magnetic clasp according to an embodiment of the present invention.

With reference now to the Drawing, FIG. 1 shows an item of neck-worn jewelry in the form of a necklace, i.e., string or strand 10 of generally spherical beads 11, which are strung in line on a flexible cord e.g., a string or wire. In this embodiment, there are smaller spacer beads 12 included between the second and third beads 11, between the fourth and fifth beads 11, and so forth. In many embodiments, the necklace would be constructed with a knot formed between successive beads, and there is a generally V-shaped valley or recess defined between any two successive beads. As shown in FIG. 1, there is a decorative clasp 14 that is attached onto one end of the necklace 10, and this clasp attaches over the necklace between any two successive beads 11 at or near the opposite end. In the illustrated embodiment, the clasp is fastens over the necklace a few inches from the end, so that the necklace is worn up on the neck with the clasp 14 visible at the front, that is, with the decorative clasp 14 visible on the wearer's neck. The remainder of the necklace hangs down as a single strand, i.e., as a pendant.

Details of the construction of the magnetic clasp 14 can be seen in the remaining views, namely, FIGS. 2 to 5.

Figure 2:
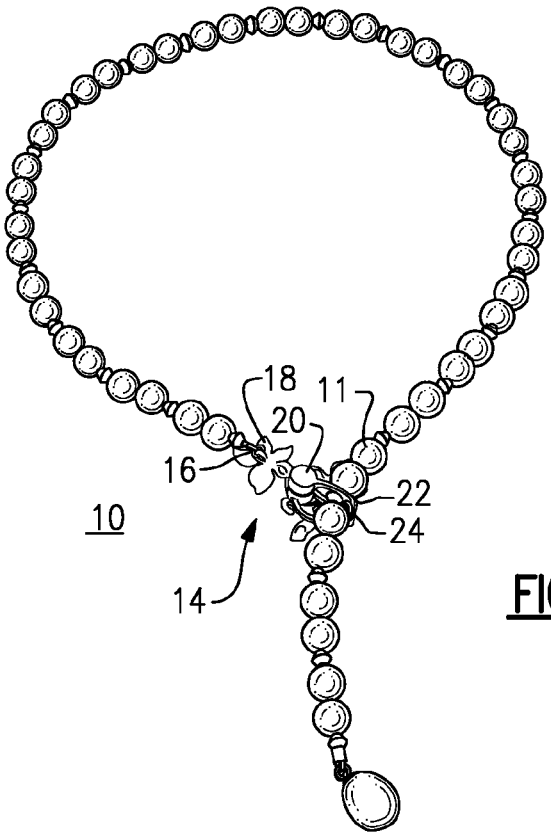
FIG. 2 is a perspective view thereof showing the back side of the clasp.

FIG. 2 shows the reverse of the necklace or strand 10 and clasp 14. The clasp 14 has an eyelet 16 at one end of a first more-or-less linear bar or arm 18, and the eyelet 16 serves as a point of attachment for the cord or wire at one end of the strand 10. The first arm 18 extends distally, i.e., away from the end of the strand 10, and a first magnet member 20 is affixed at the distal end portion of the arm 18. Then a second, curved (that is, arcuate) arm 22 continues distally from the magnet member 20 and ends at a hinge or pivot member 24.

Figure 3:
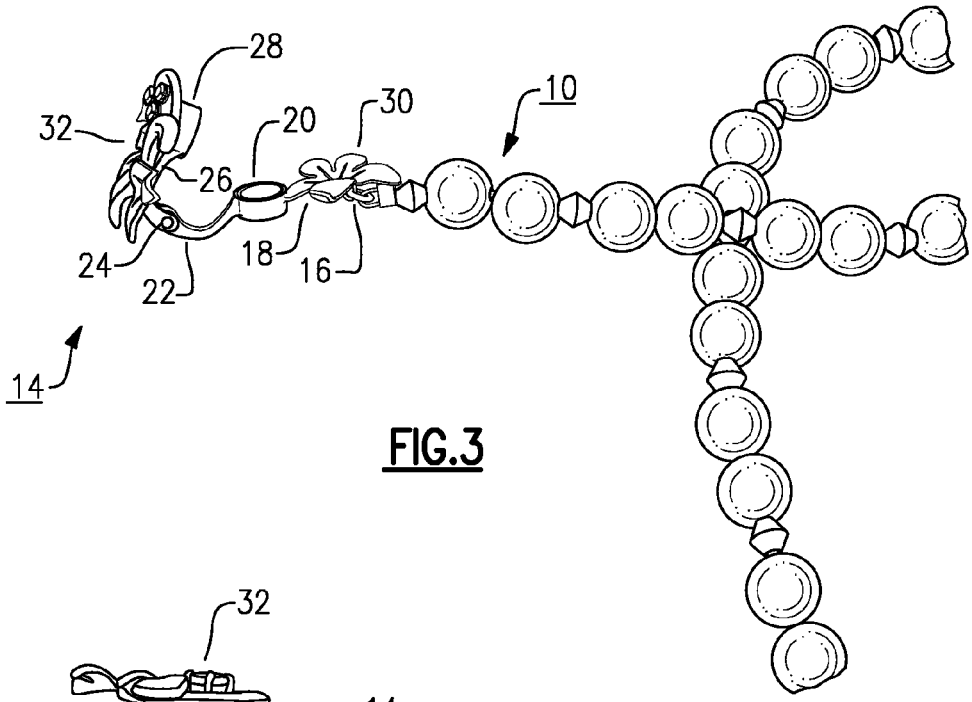
FIG. 3 is a side perspective view of the clasp of this embodiment.
Figure 4:
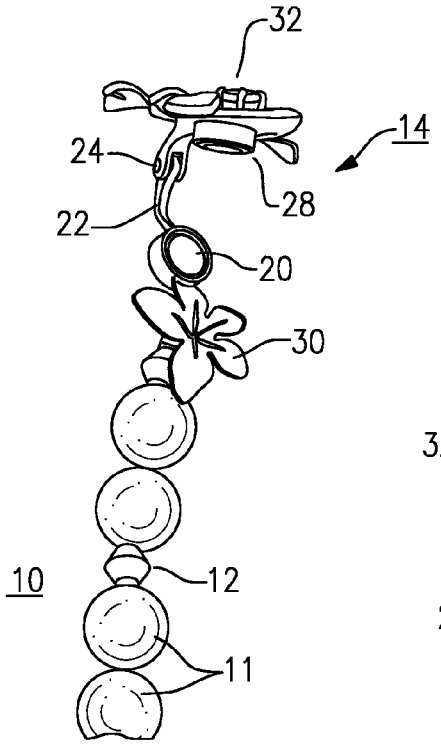
FIG. 4 is a front perspective view of the clasp in an open position.
Figure 5:
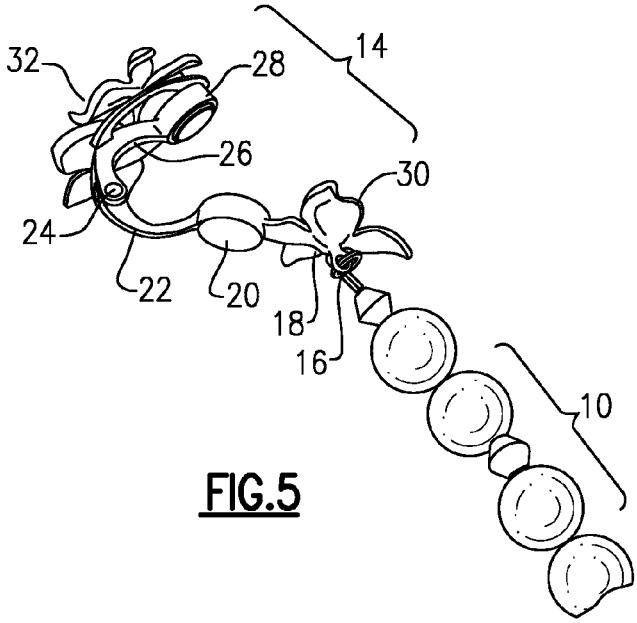
FIG. 5 is another perspective view thereof.

Turning now to FIGS. 3 to 5, it can be seen that a third, curved (i.e., arcuate) arm 26 is pivotally attached at one end to the second curved arm 22 at the pivot member 24. This allows the third arm 26 to swing in and out between a closed position (FIG. 2) and an open position (FIGS. 3, 4, and 5). As especially in the closed position, the third arcuate arm 28 is seen to extend back, i.e., proximally, from the hinge or pivot member 24. There is a second magnet 28 positioned at an end portion of the arm 26, and in the closed position of the clasp 14 the two magnets 20 and 28 magnetically engage and grip one another. However, the magnets can be pulled apart easily by the wearer wishing to put on the jewelry article, or take it off, or adjust it.

As seen in FIG. 2, the two curved arms 22 and 26 define a more-or-less oval shape that fits into the valley or gap between successive beads 11, 11 when the clasp 14 is closed. The gentle curvature here lies against the beads and does not scratch or abrade them. In this embodiment, the clasp 14 opens to the front, but in some other embodiments the clasp can open to the rear.

As seen in FIG. 1 and also in FIGS. 3, 4, and 5, the clasp 14 includes decorative leafwork, i.e., flat or shallow three-dimensional ornamental members covering the clasp mechanism at the front of the clasp 14. A first decorative leaf member 30 is disposed at the front or side of the first arm member 18, and in some embodiments the arm member 18 can be unitarily formed with the leaf member 30. Here, the magnet 20 is shown at the distal edge of the leaf member 30. Another leaf member 32 is formed on the front of the third or movable curved arm 26 and extends over the hinge or pivot member 24, the curved arm member 26 and the second magnet 28, so that these are concealed behind the leaf member 32. In some embodiments, the arm member 26 can be formed unitarily with the ornamental leaf member 32. As seen in FIG. 1 the two leaf members 30 and 32 combine to make a single visual impression.

In the illustrated embodiment, the leaf members 30, 32 are in the form of a floral design, but in other embodiments, these can be made to represent foliage, twigs, animal shapes, or arbitrary and abstract non-representational designs, depending upon the tastes and preferences of the jeweler.

In the present embodiment, the clasp 14 is formed of a sterling silver, but in other embodiments, other materials can be used. The materials may include a plastic resin, a metal, or a ceramic, for example.

Here, the magnet members 20 and 28 are in the form of shallow cylindrical cups (e.g., formed of sterling silver or other jeweler's material) with a small disk-shaped permanent magnet contained within it.

The clasp 14 is here shown used with a strand 10 formed of generally spherical beads 11 of more or less uniform size, with smaller size spacer beads 12. However, the clasp 14 can be used to advantage with beads of non-round shape, or with strands of beads or pearls that are of varying size and/or type. The clasp 14 can be used with necklace in the form of a double strand.

While the invention has been described in respect to a preferred embodiment, the invention is not limited only to that embodiment. Rather, the scope and spirit of this invention is to be defined in accordance with the appended claims.

I claim:

1. A jewelry item in which a plurality of bead members are strung in line upon a flexible cord, and a jewelry clasp is attached onto one end of the flexible cord, and closes over a narrow space defined between successive ones of said bead members, wherein the clasp comprises:

a first arm member having an eyelet therein adapted to receive said one end of said cord;

a first magnet disposed at a distal end of said first arm member;

a second arcuate arm member that extends distally from said first magnet;

a pivot member disposed at a distal end of said second arcuate arm member;

a third arcuate arm member having a pivot end joined to said pivot member and extending proximally therefrom, such that the third arcuate arm member is adapted to open out from said second arm member and close towards said second arm member, such that the bead members pull in the direction against the pivot end;

a second magnet at a proximal portion of said third arcuate arm member and positioned to engage magnetically against said first magnet, such that the third arcuate arm member closes against the second arcuate arm member by magnetic engagement only and releases therefrom by pulling the first and second magnets without requiring mechanical disengagement; and a leaf member disposed upon said third arm member and projecting laterally from the sides of said third arm member at the location of said second magnet, so as to conceal said magnets and adapted to permit a wearer to grasp and open the jewelry clasp.

2. The jewelry item of claim 1 wherein said second and third arcuate arm members bow out in respect to one another to define an oval loop therebetween when said second magnet engages closed against said first magnet.

3. The jewelry item of claim 2 wherein said third arcuate arm member is disposed behind said second arcuate arm member.

4. The jewelry item of claim 2 wherein said third arcuate arm member is disposed in front of said second arcuate arm member.

5. The jewelry item of claim 4 further comprising a first decorative leaf member disposed upon said first arm member and a second decorative leaf member disposed upon said third arm member.

6. The jewelry item of claim 5 wherein said second decorative leaf member extends proximally over said second magnet.

7. The jewelry item of claim 1 wherein said first and second magnets each include a generally cylindrical socket in which a respective permanent magnet member is fitted.

8. The jewelry item of claim 7 wherein a first decorative leaf member is disposed upon said first arm member and the aforesaid leaf member is constituted as a second decorative leaf member disposed upon said third arm member in front of said cylindrical sockets so as to conceal said cylindrical sockets and said permanent magnets.

9. The jewelry item of claim 8 wherein said second decorative leaf member is formed unitarily with the third arm member.

* * * * *